US005329918A

United States Patent [19]

Di Bari

[11] Patent Number: 5,329,918

[45] Date of Patent: Jul. 19, 1994

[54] COMBINED ELECTRIC AND GAS BURNER

[76] Inventor: Gaetano Di Bari, Via A. Diaz, 97, 22100 Como, Italy

[21] Appl. No.: 10,617

[22] Filed: Jan. 27, 1993

[51] Int. Cl.[5] ..... F24C 3/00

[52] U.S. Cl. ..... 126/39 BA; 126/39 N; 392/307

[58] Field of Search ..... 126/39 R, 39 BA, 39 N, 126/39 E, 39 H, 39 C, 39 G; 392/309, 307

[56] References Cited

U.S. PATENT DOCUMENTS

| | | | |
|---|---|---|---|
| 1,716,329 | 6/1929 | Simpson | 126/39 BA |
| 4,899,723 | 2/1990 | Pajares | 126/39 BA |

FOREIGN PATENT DOCUMENTS

| | | | |
|---|---|---|---|
| 65832 | 5/1980 | Japan | 126/39 BA |
| 65835 | 5/1980 | Japan | 126/39 BA |
| 92825 | 7/1980 | Japan | 126/39 BA |
| 273919 | 11/1989 | Japan | 126/39 BA |

*Primary Examiner*—James C. Yeung
*Attorney, Agent, or Firm*—Leo R. Carroll

[57] ABSTRACT

This invention provides for the addition of a small electrical element within the confines of a conventional gas station on a cooktop for purposes of simmer cooking which requires control of temperatures below the minimum obtainable with the minimum gas flow rate control settings. Control of power to the electrical heating element is commenced by a first microswitch after control of the gas portion of the burner has been minimized, and reignition has been disabled by operation of a second microswitch. Electrical control means include on-off heater control, continuous power control with a rheostat, or by stepwise adjustment as in a conventional stove. The electrical system and control may be incorporated within a conventual gas burner during assembly with minimum modification.

9 Claims, 2 Drawing Sheets

VALVE SETTINGS

COMBINED ELECTRIC AND GAS BURNER

BACKGROUND OF THE INVENTION

Technical Field

This invention relates generally to apparatus for providing heat for cooktop stoves and more particularly to a gas burner having an integral electrical heating element.

Background Art

When gas burners are used in conventional cooktop stoves, difficulties are commonly experienced with control of the lowest burn rate settings. Maintenance of very low Btu rates is necessary for simmering, a process in which liquids are maintained in a state just below the boiling point. Process examples include the melting of chocolate or butter, in which temperatures must be held under those that would result in burning or boiling.

Additional problems arise in the multiple burner environment within a closed cooktop stove. Here, since an individual burner is connected with each of the other burners by means of a common gas supply and by common heat conducting structures, minimum flow rate performance of that burner's valve can be influenced by the state of the local environment. For example, if three burners of a four-burner cooktop are set on high while the forth burner is set on the minimum flow simmer position, it is not unusual that that burner will go out before the heat is sufficiently reduced for simmer.

Several known solutions to this problem have been proposed with limited success. One such approach involves the use of a smaller gas burner with a lower Btu rate disposed within the center area of a larger, higher Btu rate burner. However, when a small pot is used to melt butter, the center of the pot becomes too hot while the outer circumference does not become hot enough.

Increased resolution of gas burner control have been obtained by methods of modulation of gas modulation and fuel mixtures. Systems for pulse modulation are described in U.S. Pat. No. 4,856,981 to Flanigan in which mixing rate is controlled. Krieger discloses a frequency modulation burner system for industrial furnaces in U.S. Pat. No. 4,583,936. None of these systems however, extend the dynamic range of burning at the minimum flow rate conditions required for simmering.

Solutions exit for the simmer problem with other cooking devices, such as electric slow cooking pots and microwave ovens. There, the environmental insensitivity and the fine power resolution of electrical sources can be utilized at the cost of complexity. As an example, Dills, in U.S. Pat. No. 4,093,841, discloses a low-temperature slow-cooking microwave oven, in which sensors monitor the temperatures within both a closed cooking container and within the food therein. These systems are all costly and complex, and are not adaptable to the small cooktop stove application. In addition, none provide a simmer solution coupled with the desirable features of a gas stove.

SUMMARY OF THE INVENTION

This invention features the addition of a small electrical element within the confines of a conventional gas station on a cooktop. Such a small element may be electrically controlled down to the smallest levels of heating necessary for simmering. Although complicated electronic controls may be also utilized to control the electrical elements, an additional feature of this invention is the adaptability of the design to small, less costly control provisions. Thus the electrical elements may be operated by the inclusion of a separate microswitch which can be cam actuated by rotation of a conventional gas valve stem shaft. Operation of the electrical element without gas burning can be obtained by the inclusion of a separate microswitch which can deactivate gas ignition.

It is a prime object of this invention therefor to provide a means of obtaining a simmering heat capability within the confines of conventional gas burner on a stove cooktop.

It is a further object of this invention to provide a an electrical simmering means whose control can be easily coordinated with that of the gas burner.

It is an additional object of this invention to provide a a combined electrical element and gas burner system which may be inexpensively manufactured, is structurally rigid and safe, and can be easily adapted to manufacture of conventional gas burners.

The above and other objects, features and advantages of the present invention will become more apparent from the following description when making reference to the detailed description and to the accompanying sheets of drawings.

BRIEF DESCRIPTION OF THE DRAWINGS

The details of my invention will be described in connection with the accompanying drawings, in which.

DESCRIPTION OF THE PREFERRED EMBODIMENT

Figure 1:
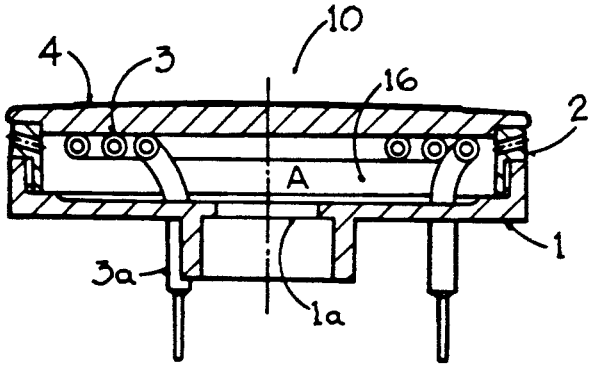
FIG. 1 is a side cross-sectional view of the combined cooktop burner of this invention in which the electrical element is disposed beneath a burner top cap.

FIG. 1 depicts a side cross-section of the primary embodiment of this invention in which combined gas and electrical burner 10 is comprised of a planar electrical heating element 3 concentrically disposed within a gas port ring 2. Burner base structure 1 provides support for port ring 2 and defines the side and bottom walls of gas mixture chamber lb. Burner top cap 4 is supported by port ring 2 and further completes the enclosure of gas mixture chamber 1*b*. Electrical element 3 may be mechanically attached to burner cap 4 by soldering, welding or other conventional means, or it may be free standing within the chamber 1*b*, supported by the semi-rigid electrical input wires 3*a*. Gas flows upward through chamber entrance 1*a* and exits through ports 2*a* radially disposed around the periphery of port ring 2.

Figure 2:
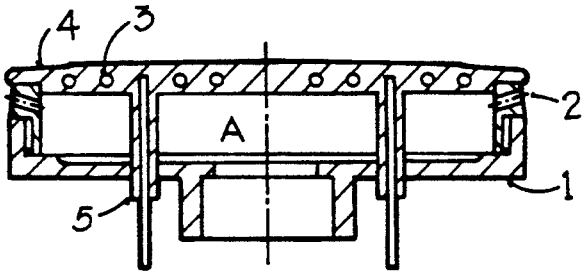
FIG. 2 is a side cross-sectional view of another embodiment of the combined cooktop burner of this invention in which the electrical element is embedded within the burner top cap.
Figure 3:
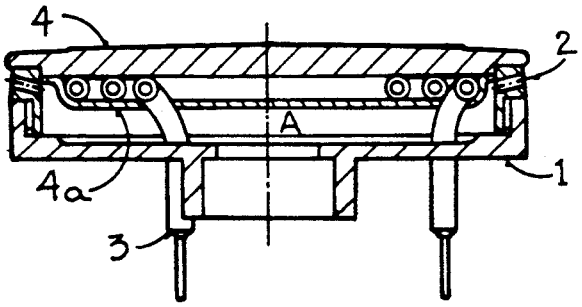
FIG. 3 is a side cross-sectional view of another version of the embodiment of the combined cooktop burner of FIG. 1 with an isolating plate disposed beneath the electrical element.
Figure 4:
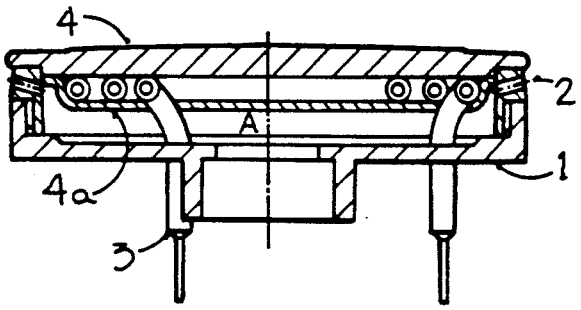
FIG. 4 is a side cross-sectional view of another version of the embodiment of the combined cooktop burner of FIG. 3 with the electrical element recessed within the burner cap.

FIGS. 2, 3, and 4 present variations in the relationship between electrical element 3 and burner cap 4. Thus in FIG. 2 electrical element 3 is completely isolated from the gas mixing chamber 1*b* by being embedded within burner cap 4. Integral tubular insulated members 5 are used to provide exiting means for input wires 3*a*. Heat transfer to the cooktop is maximized with this arrangement, at the expense of a higher cost replacement element.

FIG. 3 presents a variant of FIG. 1 in which isolation of electrical element 3 from gas mixing chamber 1*b* is obtained my means of intermediate plate 4*a* placed under electrical element 3. This design results in a either a reduced mixing chamber volume or a somewhat thicker combined burner assembly.

FIG. 4 shows a variant of FIG. 3 in which a recess is provided in the underside of burner cap 4 to provide partial space for electrical element 3. This approach recovers some of the space lost by addition of intermediate plate 4*a*, and improves heat conduction through the burner cap 4.

It will be noted that in FIGS. 1 through 4 the burner base structure 1 could be made as a single part with port ring 2. Likewise, port ring 2 could be made integral with burner cap 4 as a single part. The possibility also exists that burner base structure 1, port ring 2, and burner cap 4 could be deep drawn out of a single piece.

Figure 5:
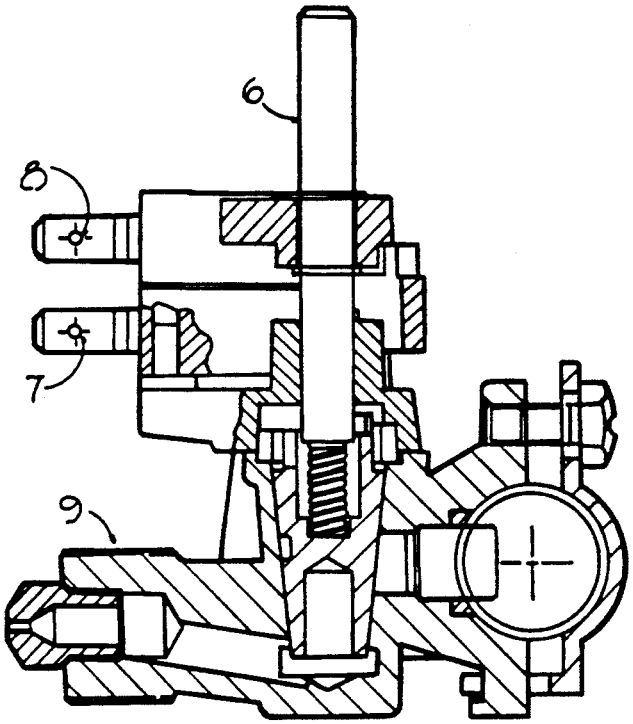
FIG. 5 is a top cross-sectional view of a gas burner valve assembly adapted to incorporate electrical.

FIG. 5 shows the cross-section of a conventional stove gas valve 9 which has been adapted to include electrical switch control of both gas ignition and the electric heating element. Microswitches 7 and 8 are mounted such that they may be cam activated progressively by rotation of valve stem 6. Microswitch 7 is utilized to control ignition of the gas while microswitch 8 turns electric heater element 3 on and off.

Figure 6:
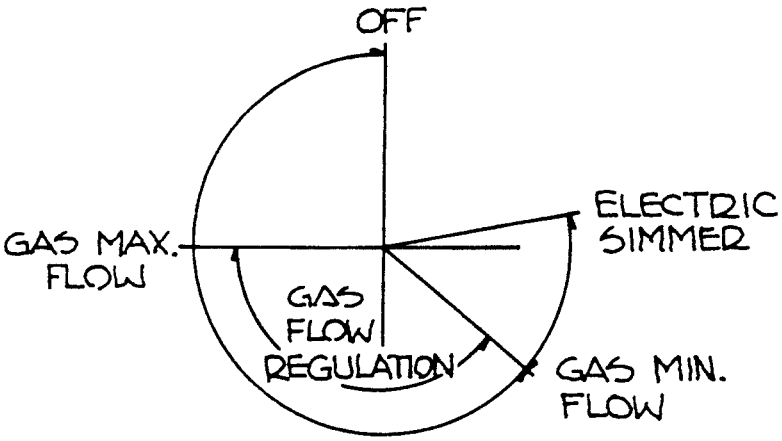
FIG. 6 is a diagrammatic illustration of the rotary control settings of the gas valve when viewed inward along the valve stem shaft.

FIG. 6 is an operational control diagram of the functioning of the combination burner with rotation of valve stem shaft 6. As viewed looking inwardly along the shaft 6 toward the cooktop, conventional counterclockwise motion turns the gas flow from OFF to MAX FLOW in the first quadrant of rotation. As rotation continues, gas flow is regulated downward until a point of minimum gas flow is reached in the third quadrant. The exact determination of this point is left to the using operator in his own environment. After this point, microswitch 7 will prevent gas reignition and then microswitch 8 will activate electric heater 3 to produce a "simmer" zone extending to an end point in the forth quadrant.

The above embodiment is that of a simple on-off control system in which a fixed power electric heater element is switched on in place of an unchanged gas burner system. It will be recognized however, that at the expense of cost and complexity, many more sophisticated known control systems may be utilized. For instance, the heating element power can be continuously controlled as with a rheostat, or can be adjusted step-wise as in a conventional electric stove. Likewise modern heat sensors, timers and electronic controls can provide improved power control resolution for different simmer cooking conditions.

It is to be understood therefore, that the foregoing description is merely illustrative of the preferred embodiment of the invention and that the scope of the invention is not to be limited thereto, but is to be determined by the scope of the appended claims.

What is claimed is:

1. A combined burner for a stove cooktop having at least one cooking station, comprising:

a gas burner having a plurality of gas exit ports through which a combustible gas may flow, wherein said gas burner is configured as an annular ring with said gas ports being circumferentially disposed under said cooking station so that said gas may be mixed with air and ignited to produce heat under said cooking station for food cooking;

a source of a pressurized combustible gas in fluid communication with said gas burner;

a plurality of electric heating elements concentrically disposed within said annular ring gas burner under said cooking station for simmer cooking of foods;

burner base means for structural support of said electric heating elements and said gas burner to said stove cooktop;

a top cap member having a top, bottom and upward sides, said top cap member being supported by said base means and disposed such that the bottom side of said top cap covers said electric heating elements, and the top side of said topcoat member lying in a plane substantially parallel with the plane of said stove cooktop.

an enclosed gas/air mixing chamber defined by top, bottom and side walls, with said chamber being disposed under said top cap member such that said top cap member further comprises the top wall of said chamber.

gas valve control means for adjustment of gas flow rate to said gas burner ports, said gas valve control means having a valve stem shaft for manual operation; and control means having a first microswitch actuated by operation of said valve shaft for adjustment of power to said electric heating elements so as to provide simmer cooking heating adjacent said gas burner heating under said cooking station.

2. A combined burner for a stove cooktop having at least one cooking station as recited in claim 1, wherein said electric heating element is concentrically embedded within said top cap member.

3. A combined burner for a stove cooktop having at least one cooking station as recited in claim 1, wherein said electric heating element is concentrically disposed within said enclosed gas/air mixing chamber.

4. A combined burner for a stove cooktop having at least one cooking station as recited in claim 3, further comprising an enclosed gas/air mixing chamber having a separate sealed top wall member substantially parallel to said top cap member, and being disposed under said electric heating element so that said electric element may be isolated from said mixing chamber.

5. A combined burner for a stove cooktop having at least one cooking station as recited in claim 4, wherein the bottom side of said top cap is recessed so as to define a volume into which said electric heater element may be partially embedded.

6. A combined burner for a stove cooktop having at least one cooking station as recited in claim 1, wherein said control means for adjustment of gas flow rate further comprises a second microswitch actuated by operation of said valve shaft for activation and deactivation of gas ignition.

7. A combined burner for a stove cooktop having at least one cooking station as recited in claim 6, wherein actuational operation of said first microswitch for activation of power to the electrical heater elements is sequenced after deactivation of gas ignition.

8. A combined burner for a stove cooktop having at least one cooking station as recited in claim 7, wherein said control means for adjustment of power to said electric heating elements further comprises a rheostat.

9. A combined burner for a stove cooktop having at least one cooking station as recited in claim 7, wherein said control means for adjustment of power to said electric heating elements further comprises a discrete voltage divider which is operated stepwise.

* * * * *